US007478918B2

(12) United States Patent
Petzl et al.

(10) Patent No.: US 7,478,918 B2
(45) Date of Patent: Jan. 20, 2009

(54) LED-BASED LAMP EQUIPPED WITH A COMPACT CASE AND WITH MULTIDIRECTIONAL ORIENTATION

(75) Inventors: Paul Petzl, Barraux (FR); Raphael Bortolotti, Crolles (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 11/798,263

(22) Filed: May 11, 2007

(65) Prior Publication Data

US 2007/0291478 A1 Dec. 20, 2007

(30) Foreign Application Priority Data

Jun. 20, 2006 (FR) ..... 06 05466

(51) Int. Cl.
*F21L 4/04* (2006.01)

(52) U.S. Cl. ..... 362/205; 362/157; 362/167; 362/177; 362/184; 362/190; 362/200; 362/319; 200/60

(58) Field of Classification Search ..... 362/157, 362/167, 177, 184, 190, 205, 319, 200; 200/60
See application file for complete search history.

(56) References Cited

U.S. PATENT DOCUMENTS 5,359,165 A * 10/1994 Leveque et al. ..... 200/317
5,738,432 A * 4/1998 Okko et al. ..... 362/103
6,672,972 B1 1/2004 Stone
6,951,409 B2 * 10/2005 Hsien ..... 362/191
6,953,259 B2 * 10/2005 Parsons et al. ..... 362/191
6,979,098 B2 12/2005 Petzl et al.
2003/0179570 A1 * 9/2003 Schnell ..... 362/116
2004/0156194 A1 8/2004 Petzl et al.

FOREIGN PATENT DOCUMENTS

FR 2 826 706 A1 1/2003
FR 1 445 532 A1 8/2004

* cited by examiner

*Primary Examiner*—Sandra L. O'Shea
*Assistant Examiner*—Meghan K. Dunwiddie
(74) *Attorney, Agent, or Firm*—Oliff & Berridge, PLC

(57) ABSTRACT

A portable lamp comprises a LED-based lighting module, a rotary selector switch for selecting the operating mode, and a power supply battery, the whole assembly being housed in a compact case which is coupled to a fixing plate with multi-directional orientation. The lighting module and the selector switch are arranged side by side on the front face, the fixing plate being joined to the case by a ball and socket joint arranged in a housing provided at the base of the case between the selector switch and the lighting module.

9 Claims, 4 Drawing Sheets

LED-BASED LAMP EQUIPPED WITH A COMPACT CASE AND WITH MULTIDIRECTIONAL ORIENTATION

BACKGROUND OF THE INVENTION

The invention relates to a portable lamp comprising a lighting module with light-emitting diodes LED, a selector switch for selecting the operating mode, and a power supply battery, the whole assembly being housed in a case which is joined to a fixing plate.

STATE OF THE ART

The document EP-A-1445532 describes a head-mounted electric lamp comprising a lighting module with light-emitting diodes LED arranged on the front face, and a lighting control switch situated on the top side face of the case. A fixing plate for fixing an elastic strap is shaped as a U-shaped clamp articulated on the case around a horizontal axis enabling the lamp to be directed in an upwards direction. The lamp is supplied by three cylindrical batteries housed inside the case. The size of such a case is fairly large, and directing of the lamp is limited to a simple swivelling movement around a horizontal axis.

It has already been proposed to fit a lighting lamp on a support by means of a ball and socket joint. Apart from the large length of the case, the ball and socket joint is situated at the rear of the case, and the support is in the shape of a grip.

OBJECT OF THE INVENTION

The object of the invention consists in providing a lamp with lighting LEDs having a compact size, allowing selection of different operating modes, and with multidirectional orientation.

The lamp according to the invention is characterized in that the LED-based lighting module and the selector switch are arranged side by side on the front face, and that the fixing plate is connected to the case by a ball and socket joint arranged in a housing provided at the base of the case between the selector switch and the lighting module.

The size of the lamp in the depthwise direction is very compact, and the ball and socket joint allows multidirectional orientation of the fixing plate with respect to the case of the lamp, and fitting on different supports. The fixing plate also acts as a cover able to be handled by turning on the rear face or the front face of the case.

According to a preferred embodiment, the selector switch is mounted rotating on an axis perpendicular to the front face and comprises a gripping lug equipped with a mobile guide spigot for guiding along a circular groove arranged in the narrow side face of the case. The groove is provided with a plurality of indexing notches to define successive angular positions relative to the various operating modes. The lighting module comprises three white LEDs arranged at the apexes of a triangle, and a central red LED.

The case advantageously has a flattened shape. Power supply of the LEDs is performed by means of two flat batteries stacked one above the other, accessible by means of a rotary cover integrated in the rear face of the case.

The fixing plate further comprises means for fitting an elastic strap or a safety block, and is equipped with a clip with a steel wire spring for hooking onto a support means.

BRIEF DESCRIPTION OF THE DRAWINGS

Other advantages and features will become more clearly apparent from the following description of a particular embodiment of the invention given as a non-restrictive example only and represented in the accompanying drawings, in which.

DETAILED DESCRIPTION OF A PREFERRED EMBODIMENT OF THE INVENTION

Figure 1:
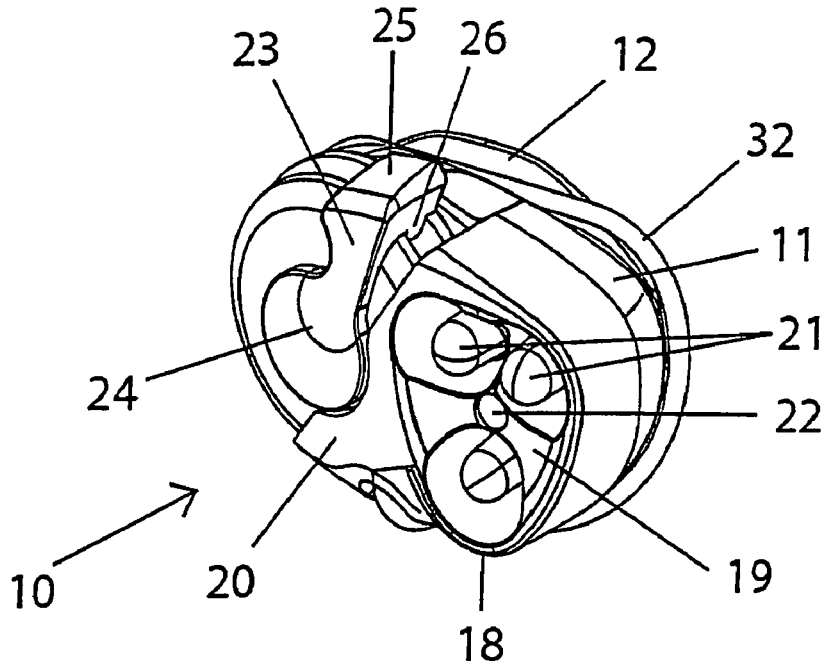
FIG. 1 is a perspective view of the lamp according to the invention, the fixing plate being located against the rear face of the case.

With reference to the figures, a LED-based lamp 10 comprises a case 11 mounted on a fixing plate 12 by means of a ball and socket joint 13 enabling multidirectional orientation.

The case 11 is compact in the depthwise direction, and contains at least one button cell 14 of circular shape accessible via a rotating cover 16 integrated in a circular opening 17 arranged in the rear face 15.

The lighting module 18 is housed in a recess 19 of the front face 20 of the case 11, and comprises three white LEDs 21 arranged at the apexes of a triangle and a red LED 22 inserted in the centre of the three white LEDs 21.

A rotary selector switch 23 with several positions moves a contact slipper on a printed circuit board (not represented) to select the different operating modes of the lamp 10.

By successive pivoting of the selector switch 23 from right to left, the following states are obtained:

unlit and mechanical locking at end of travel to the right,
unlit and unlocked,
different lighting powers in the increasing direction,
flashing of the three white LEDs 21,
flashing of the central red LED 22,
red LED 22 continuously lit,
extinction at end of travel to the left.

The selector switch 23 is arranged next to the lighting module 18 and is mounted rotating on an axis 24 perpendicular to the front face 20. The axis 24 of the selector switch 23 extends in a parallel direction to the light beam emitted by the LEDs 21, 22.

Actuation of the selector switch 23 is performed by means of a gripping lug 25 which is equipped with a guide spigot 26 moving along a circular groove 27 arranged in the narrow side face of the case 11. The groove 27 preferably comprises a plurality of indexing notches 33 cooperating with the spigot 26 to define the successive angular positions relative to the various incremental operating modes.

The ball and socket joint 13 is securedly attached to the fixing plate 12 and is engaged in a housing 28 of complementary shape provided at the base of the case 11 opposite the gripping lug 25 when it is in the unlit locked end-of-travel position. The fixing plate 12 presents a flattened shape on the outside, and a dish 29 on the inside. Two slits 30 made in the fixing plate 12 enable an elastic strap to be fitted and removed to constitute a headlamp.

The fixing plate 12 is further provided with two holes 31 for use of a safety block, and with a stainless steel spring-loaded clip 32 for hooking onto any type of support, for example a webbing, pocket, elastic strap, belt, etc. . . .

Operation of the lamp and multiple orientation of the fixing plate 12 are as follows:

The various operating modes of the LEDs 21, 22 are obtained by incremental movement by swivelling of the selector switch 23. A specific lighting mode corresponds to each stable position of the selector switch 23 in a notch 33.

The ball and socket joint 13 enables multidirectional orientation of the fixing plate 13 with respect to the case 11 of the lamp 10, and also enables fitting on different supports.

Figure 3:
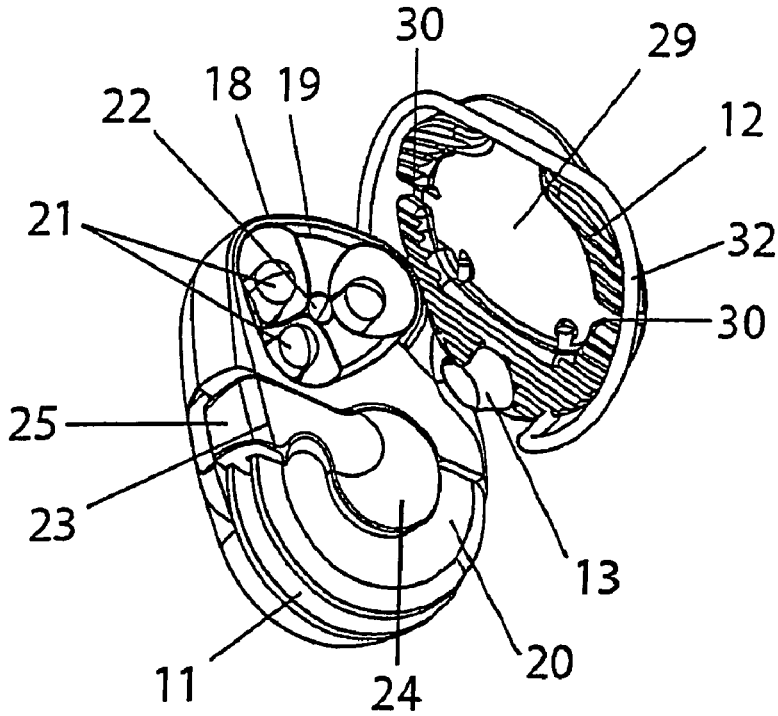
Figure 4:
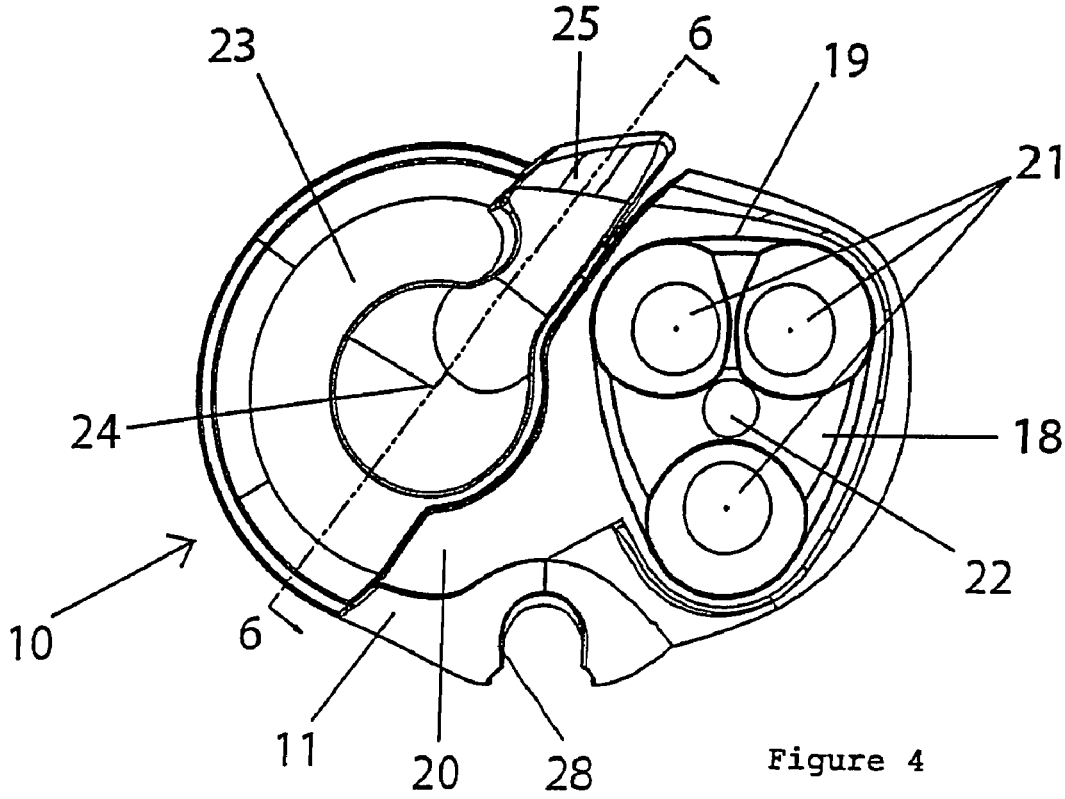
FIG. 4 is a front view of the lamp of FIG. 1, the fixing plate with its ball and socket joint connection not being represented.
Figure 5:
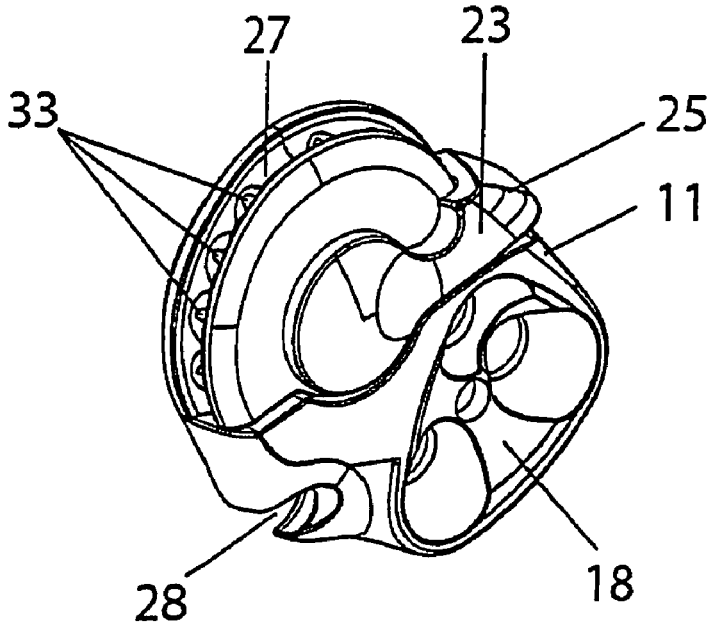
FIG. 5 is a perspective side view of the lamp showing the groove with the indexing notches of the selector switch.
Figure 7:
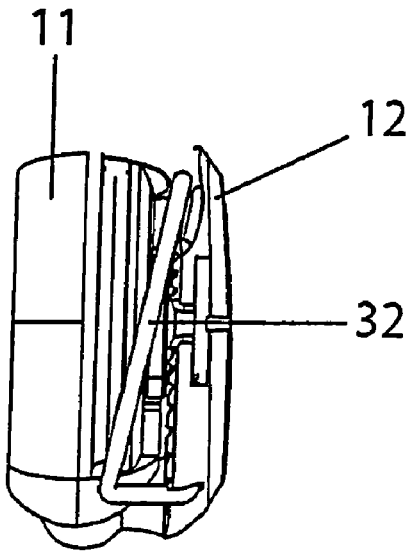
FIG. 7 shows a side view of the lamp with the fixing plate located in the cover position on the front face for protection of the LEDs.
Figure 6:
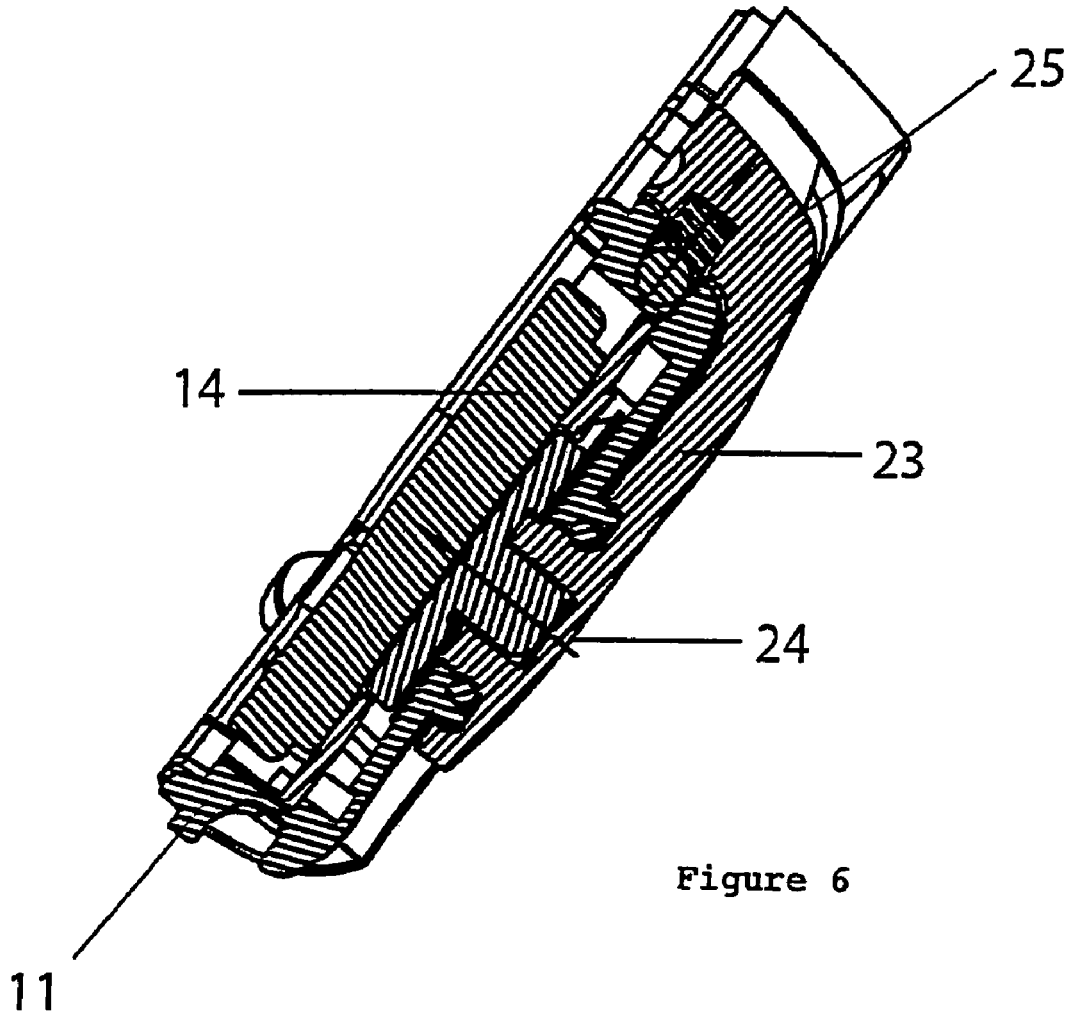
FIG. 6 illustrates a cross-sectional view along the line 6-6 of FIG. 4.

On the side where the dish 29 is located, the fixing plate 12 can press on the front face 20 so as to cover the lighting module 18 with the LEDs 21, 22, and the selector switch 23 (see FIGS. 3 and 7). The case 11 of the lamp is tilted 90° downwards, followed by rotation through 180° with respect to the axis of the foot of the ball and socket 13, and is finally tilted upwards 90°.

The flattened outside of the fixing plate 12 also enables the lamp to be placed on a flat surface (table or other).

Figure 2:
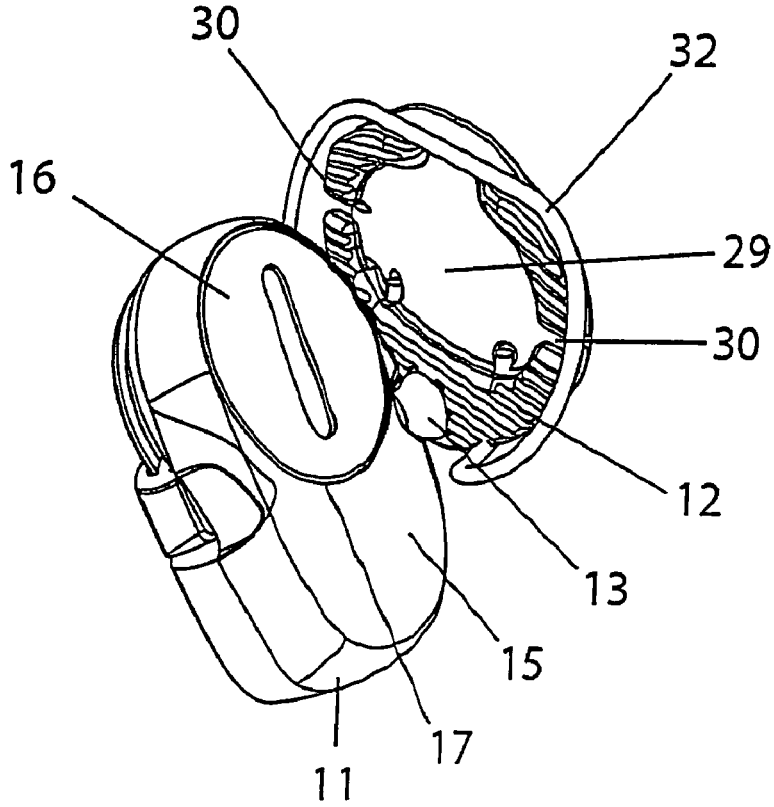
FIGS. 2 and 3 respectively show perspective views of the rear face and of the front face of the lamp, the fixing plate being represented in the opened-out position.

The fixing plate 12 can also be pressed against the rear face of the case 11 (FIGS. 2 and 1). It can be associated with an elastic strap, or a safety block, and can be clipped onto any support due to the presence of the spring-loaded clip 32.

It is clear that the lighting module 18 can be constituted by a different number of LEDs, or by a single power LED. The rotary selector switch 23 can also be replaced by a momentary contact pushbutton salient from the front face 20.

The invention claimed is:

1. A portable lamp comprising:

a case, a LED-based lighting module, a selector switch for selecting the operating mode, a fixing plate and a power supply battery, wherein:

the LED-based lighting module and the selector switch are arranged adjacent to one another on a front face of said case, said selector switch having an axis extending perpendicular to the front face, and the fixing plate is joined to the case by a ball and socket joint arranged in a housing provided at a base of the case between the selector switch and the lighting module.

2. The lamp according to claim 1, wherein said selector switch is fitted rotating on said axis.

3. The lamp according to claim 2, wherein the rotary selector switch comprises a gripping lug equipped with a guide spigot able to move along a circular groove arranged in a narrow side face of the case.

4. The lamp according to claim 3, wherein the groove is equipped with a plurality of indexing notches to define successive angular positions relating to different operating modes.

5. The lamp according to claim 1, wherein the fixing plate is arranged as a multidirectional cover able to be handled by turning on a rear face or on the front face of the case.

6. The lamp according to claim 1, wherein the fixing plate is capable of being fitted with an elastic strap or a safety block.

7. The lamp according to claim 1, wherein the fixing plate is equipped with a spring-loaded clip made of steel wire for hooking onto a support.

8. The lamp according to claim 1, wherein the lighting module comprises three white LEDs arranged at apexes of a triangle, and one red LED positioned at a centre of the three white LEDs.

9. The lamp according to claim 1, wherein the case has a flattened shape, and the power supply battery is formed by at least one flat button cell accessible by a rotating cover integrated in a circular opening of the rear face.

* * * * *